US010871285B2

(12) United States Patent
Solonin

(10) Patent No.: US 10,871,285 B2
(45) Date of Patent: Dec. 22, 2020

(54) PYROLYSIS BOILER

(71) Applicant: Mark Solonin, Samara (RU)

(72) Inventor: Mark Solonin, Samara (RU)

(73) Assignee: Pyroheat OÜ, Tallinn (EE)

( * ) Notice: Subject to any disclaimer, the term of this patent is extended or adjusted under 35 U.S.C. 154(b) by 96 days.

(21) Appl. No.: 16/333,329

(22) PCT Filed: Sep. 5, 2017

(86) PCT No.: PCT/RU2017/000605
§ 371 (c)(1),
(2) Date: Mar. 14, 2019

(87) PCT Pub. No.: WO2018/052337
PCT Pub. Date: Mar. 22, 2018

(65) Prior Publication Data

US 2019/0249870 A1 Aug. 15, 2019

(30) Foreign Application Priority Data

Sep. 15, 2016 (RU) ..... 2016137008

(51) Int. Cl.
*F23B 10/02* (2011.01)
*F23L 1/00* (2006.01)
(Continued)

(52) U.S. Cl.
CPC ..... *F23B 10/02* (2013.01); *F23G 5/027* (2013.01); *F23G 5/16* (2013.01); *F23G 7/105* (2013.01);
(Continued)

(58) Field of Classification Search
CPC ..... F23B 10/02; F23B 90/06; F23B 50/06; F23G 5/16; F23G 7/105; F23G 5/027;
(Continued)

(56) References Cited

U.S. PATENT DOCUMENTS 3,785,304 A * 1/1974 Stookey ..... F23G 5/16 110/346
5,628,261 A * 5/1997 Beckstead ..... F23G 5/027 110/186
(Continued)

FOREIGN PATENT DOCUMENTS

CN 105135437 A 12/2015
CZ 2008191 A3 10/2009
(Continued)

*Primary Examiner* — David J Laux
(74) *Attorney, Agent, or Firm* — Berggren LLP

(57) ABSTRACT

Heat and power engineering, specifically being heating devices includes a pyrolysis boiler, in which, wood is subjected to high-temperature gasification and pyrolysis with subsequent burning off of pyrolysis gases. A stable and controllable gasification of wood with a natural high moisture content is achieved, and at the same time, a highly efficient transfer of combustion heat to a liquid heat-transfer agent is obtained. A gasification chamber is positioned between two compartments of a pyrolysis gas combustion chamber of the pyrolysis boiler, while the external wall of the combustion chamber is used as a heat-transfer surface, and at the same time, neither the fuel bunker nor the gasification chamber are in contact with water.

11 Claims, 2 Drawing Sheets

(51) Int. Cl.

| | |
|---|---|
| ***F23L 9/00*** | (2006.01) |
| ***F24H 1/00*** | (2006.01) |
| ***F23G 5/16*** | (2006.01) |
| ***F23G 7/10*** | (2006.01) |
| ***F23G 5/027*** | (2006.01) |

(52) U.S. Cl.
CPC ..... *F23L 1/00* (2013.01); *F23L 9/00* (2013.01); *F24H 1/00* (2013.01); *F23G 2201/303* (2013.01); *F23G 2202/103* (2013.01); *F23G 2209/261* (2013.01)

(58) Field of Classification Search
CPC ..... F23G 2209/261; F23G 2202/103; F23G 2201/303; F23L 1/00; F23L 9/00; F23L 9/02; F24H 1/00
See application file for complete search history.

(56) References Cited

U.S. PATENT DOCUMENTS

| | | | | |
|---|---|---|---|---|
| 6,976,439 | B2 * | 12/2005 | Uchida | F23C 5/32 110/302 |
| 7,438,024 | B2 * | 10/2008 | Bast | F23B 1/26 122/16.1 |
| 8,464,704 | B2 * | 6/2013 | Brown | F24B 5/026 126/77 |
| 8,640,655 | B2 * | 2/2014 | Furman | F24H 1/0063 122/16.1 |
| 8,789,478 | B2 * | 7/2014 | Kaneko | F23G 5/50 110/190 |
| 9,097,436 | B1 * | 8/2015 | Smelcer | F23N 1/02 |
| 9,310,071 | B2 * | 4/2016 | Duignan | F23B 60/02 |
| 2008/0041357 | A1 * | 2/2008 | Brown | F24B 1/006 126/77 |
| 2010/0083883 | A1 * | 4/2010 | Hofer | F22B 9/16 110/234 |
| 2016/0138803 | A1 * | 5/2016 | Carabin | F23G 5/033 110/346 |

FOREIGN PATENT DOCUMENTS

| | | | |
|---|---|---|---|
| DE | 3411822 | A1 | 10/1985 |
| EP | 2615369 | A1 | 7/2013 |
| EP | 2821698 | A1 | 1/2015 |
| RU | 2443759 | C1 | 2/2012 |
| RU | 2476770 | C2 | 2/2013 |
| RU | 2578550 | C1 | 3/2016 |
| RU | 164691 | U1 | 9/2016 |

* cited by examiner

PYROLYSIS BOILER

PRIORITY

This application is a U.S national application of the international application number PCT/RU2017/000605 filed on Sep. 5, 2017 and claiming priority of Russian national application RU2016137008 filed on Sep. 15, 2016 the contents of all of which are incorporated herein by reference.

FIELD OF INVENTION

The invention relates to heat power engineering, in particular to heating devices, in which solid fuel of plant origin (firewood, wood waste, chips, straw) is subjected to high-temperature gasification (pyrolysis) followed by the combustion of pyrolysis gases.

BACKGROUND OF THE INVENTION

Prior art describes a pyrolysis (gasification) boiler, containing a hopper for solid fuels, a gasification chamber and a pyrolysis gas combustion chamber united by a common double-walled vertical housing with heat-transfer fluid (water) circulating between these walls. The vast majority of commercially available pyrolysis boilers are made according to this scheme, for example, products manufactured by Astra, Atmos, Attack, Buderus, Dakon, Cichewic, Heiztechnik, Kostrzewa, Orlan, Opop, Viessmann.

The advantage of this technical solution, which has led to its wide distribution, is the effective transfer of combustion heat to the heat-transfer fluid. At the same time, the design has several disadvantages, because water, the temperature of which cannot exceed 100° C, is in direct contact with the external walls of the fuel hopper and the gasification chamber; wherein the main disadvantage can be phrased as follows: "something that should be very hot is cooled". To ensure efficient and sustainable gasification of wood, it is necessary to maintain a temperature of 100-200° C. in the upper part of the hopper (drying zone), 300-550° C. in the lower part of the hopper (dry distillation zone) and 750-900° C. in the active zone of the gasification chamber, but the "water jacket" surrounding the hopper and the gasification chamber prevents the provision of such a thermal regime.

The practical consequences of this are the low efficiency and instability of the solid fuel gasification process, the need to use wood that has been dried for years and has a moisture content of up to 20% (which the conscientious manufacturer notifies the users about), deposits of tar and ash on the walls of the fuel hopper and gasification chamber, which increases the cost and complicates the operation of the heating device.

In addition, direct contact of the heat-transfer fluid (water) with the walls of the gasification chamber, which contains tens or even hundreds of kilograms of hot coal, can lead to rapid water boiling and to an explosion of the boiler in the event of an emergency failure of the forced circulation system. For preventing this danger, additional systems need to be installed in the heating device composition, which again makes it more complicated and expensive. Several technical solutions are known that are aimed at ensuring a high temperature in the gasification chamber of the pyrolysis boiler.

Thus, a pyrolysis heating boiler is known, which contains a hopper for solid fuel and a gasification chamber, placed in a common vertical housing with a "water jacket", wherein the pyrolysis gas combustion chamber is in the form of a spiral pipe and placed inside the gasification chamber (see EP 2 821 698 A1). In addition to the aforementioned disadvantages of direct contact of the heat-transfer fluid with the walls of the hopper and the gasification chamber, the disadvantages of this technical solution are: the complexity and high cost of manufacturing a spiral chamber (double curvature surface) of heat-resistant steel, a lack of preheating for the secondary air pumped into the combustion chamber, as well as the high complexity of cleaning the internal surfaces of the hopper and the gasification chamber.

A pyrolysis heating device is known, which contains a hopper for solid fuel, a gasification chamber, a pyrolysis gas combustion chamber, which are combined in a common vertical housing, which contains a spiral water-tube heat exchanger surrounding only the pyrolysis gas combustion chamber, and the side surface and bottom of the gasification chamber are equipped with high-duty thermal insulation (see EP 2 615 369 A1). The disadvantages of this technical solution are: use of a heat exchanger circuit (liquid in a spiral pipe surrounded by the slow flow of hot combustion products) that is inefficient in terms of heat transfer, high complexity of maintenance (cleaning of soot) for such a heat exchanger, the extremely difficult transfer of heat from the pyrolysis gas combustion zone to the bottom of the gasification chamber with a thick layer of thermal insulation.

A gas-generating heating device is known, in which the fuel hopper and gasification chamber are combined into a single vertical housing, and the pyrolysis gas combustion chamber is in the form of a ring concentrically surrounding the upper part of the gasification chamber (see DE 3411822A1). The disadvantages of this technical solution are: a selection of a direct (ascending) gasification scheme that is not optimal for gasifying wood fuel, no heating of secondary air, the extremely uneven composition of the gas mixture in the combustion chamber due to the supply of secondary air at one point of the annular chamber, hampered by to the presence of a wide air gap during the heat transfer from the combustion zone to the "water jacket".

Similarly to DE 3411822 A1, a gas-generating heating device (see RU 2578550 C1) is disclosed, wherein the above-mentioned disadvantages are aggravated by the presence of a spherical, moving and rotating grate that is complicated to operate and expensive to manufacture. In addition, the devices described in EP 2 615 369 A1, DE 3411822 A1, RU 2578550 C1 use a cylindrical hopper and a cylindrical gasification chamber, which imposes additional restrictions on the shape and dimensions of the wood fuel used.

A gas-generating heating device is known, which contains a rectangular fuel hopper, a. gasification chamber and a pyrolysis gas combustion chamber combined in a single vertical housing, in which the flow of hot combustion products from the combustion chamber washes and heats the uninsulated metal side walls of the hopper and the gasification chamber (see CZ 2008191 A3). This patent does not contain (neither in the claims, in the description, nor on the graphic illustration) the method for transferring the combustion heat to the heat-transfer fluid nor the possible location of the heat-transfer fluid (circulation, purging). Thus, the embodiment of the described technical solution is impossible without additional inventive activity, which calls into question the legality of the patent issuance.

Furthermore, tests with this type of heat generators have shown that a positive feedback of the following type arises in them: an accidental increase in the generation of pyrolysis gas leads to an increase of temperature in the combustion chamber, combustion products heat the gasification chamber walls even more, generation of pyrolysis gas is further enhanced, etc. Even if the use of expensive heat-resistant steels allows to prevent the destruction of the structure, this mode of operation (forced and uncontrollable) does not meet the requirements of the users of the heating devices.

A pyrolysis heating device is known, consisting of two modules connected to a gas duct: a heat generator and a fire-tube heat exchanger, wherein the heat generator contains in a single vertical housing a rectangular hopper for solid fuels, a gasification chamber with heat-resistant thermal insulation coating the inner surface of the side walls, and a combustion chamber below it, which is divided into two symmetrical, parallel, horizontal compartments into which air is supplied in an amount that is 2-3 times greater than that necessary for the complete combustion of pyrolysis gas (see RU 164691 U1), Tests with this design showed that the adopted scheme for transferring the pyrolysis gas combustion heat into the gasification chamber (only from the bottom of the gasification chamber) does not provide the temperature regime required for the gasification of particularly difficult types of fuel (for example, raw chips at 50% moisture content) over the entire height of the gasification chamber. In addition, the proposed scheme for transferring heat to the heat transfer fluid (mass transfer of hot combustion products mixed with excess air) requires the use of a heavy and large fire-tube heat exchanger.

BRIEF DESCRIPTION OF THE INVENTION

The technical results that can be achieved with the proposed claimed invention are: a stable and controlled gasification of wood fuel with a natural (i.e., high) moisture content, complete and clean combustion of pyrolysis gas (with minimal emissions of carbon monoxide and soot) in combination with a high efficiency of heat transfer to the heat transfer fluid and minimal dimensions and weight of the structure.

The specified technical result is achieved by a pyrolysis boiler, containing, in a single vertical housing, a rectangular hopper for solid fuel and a gasification chamber below it, which has an internal heat-resistant thermal insulation coating, and a window with a grate for the exit of pyrolysis gases; a pyrolysis gas combustion chamber in the form of two symmetrical, parallel, horizontal compartments; ducts supplying primary and secondary air, as well as a pressure fan installed outside the housing; a double-walled water cavity surrounding the pyrolysis gas combustion chamber in such a way that the outer wall of the combustion chamber is also the inner wall of the water cavity, the gasification chamber is placed with no gap between the above-mentioned two compartments of the pyrolysis gas combustion chamber, and the horizontal slots are located into the side surfaces of the compartments of combustion chamber facing the gasification chamber, which ensure flow of pyrolysis gas flow passes from the outlet window of the gasification chamber to the combustion chamber with the flow turning 90 degrees left and right.

The ducts supplying primary and secondary air can be made in the form of flat ducts and installed on the side surfaces of the combustion chamber compartments facing the gasification chamber, while these ducts cover only a part of the side surface area of the combustion chamber compartments.

The ducts supplying primary and secondary air can also be made in the form of a flat grid of circular or rectangular pipes, installed on the side surfaces of the combustion chamber compartments facing the gasification chamber, wherein these pipes cover only part of the side surface area of the combustion chamber compartments.

The nozzles for supplying secondary air can be placed in the duct in such a way that the flow of secondary air coming from them moves at a speed of about 10-20 m/s parallel to, in the same direction as and in close proximity to the flow of pyrolysis gas entering through the above-mentioned horizontal slots into the combustion chamber compartments.

The above-mentioned horizontal slots of the pyrolysis gas inlet can be 2-3 times shorter than the length of the combustion chamber compartment and be located at the front end of the combustion chamber compartments.

A figured insert made of heat-resistant insulating material can be installed in each compartment of the combustion chamber opposite the horizontal slot of the pyrolysis gas inlet, covering at least two surfaces of the combustion chamber, i.e., the bottom and side wall opposite the said horizontal slot.

Each compartment of the combustion chamber can be equipped with a longitudinal horizontal partition, the length of which is less than the length of the compartment, wherein the partition without a gap is in contact with the front end of the combustion chamber compartment.

The above-mentioned longitudinal horizontal partition can be made in the form of a flat box, with the air flow moving inside it and the outer surface of the box containing nozzle openings for supplying secondary air into the combustion chamber.

The above-mentioned water cavity can contain at least two flame tubes, the entrance to which is connected to the outlet of the combustion chamber compartments by means of a gas flue, and the exit of which is connected to a smoke flue opening to the atmosphere by means of a gas flue.

These design solutions ensure the achievement of the claimed technical result, wherein the totality of such solutions cannot be found in any of the known pyrolysis boilers, thus the claimed utility model meets the criteria of novelty.

The disclosed device can be manufactured with standard equipment using technological processes and materials known and traditionally used in manufacturing heating boilers. Therefore, the claimed utility model meets the criteria of industrial applicability.

BRIEF DESCRIPTION OF THE DRAWINGS

The arrangement of the pyrolysis boiler is illustrated by drawings.

DETAILED DESCRIPTION OF THE INVENTION

Figure 1:
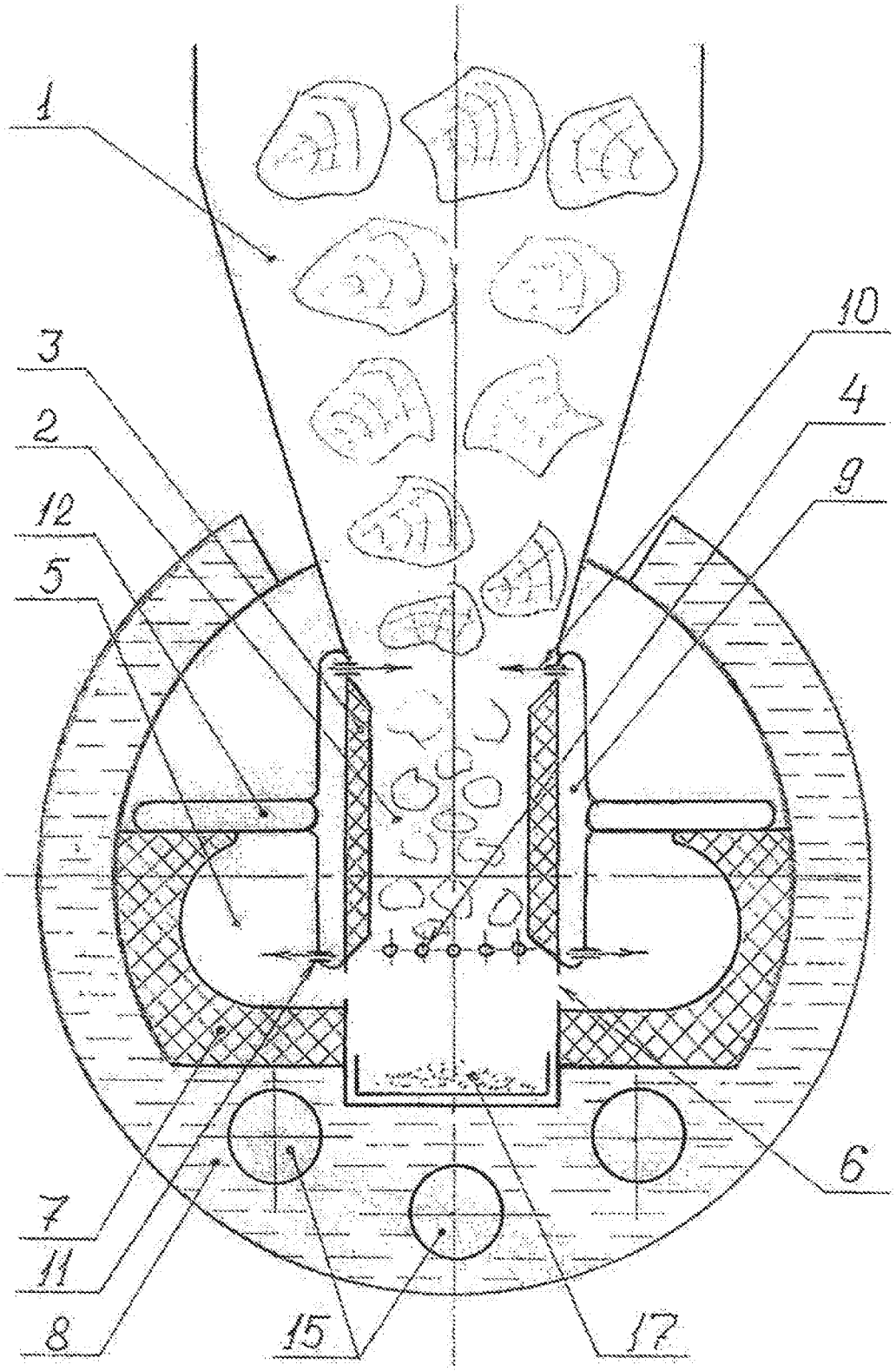
FIG. 1 shows a cross section of the device.
Figure 2:
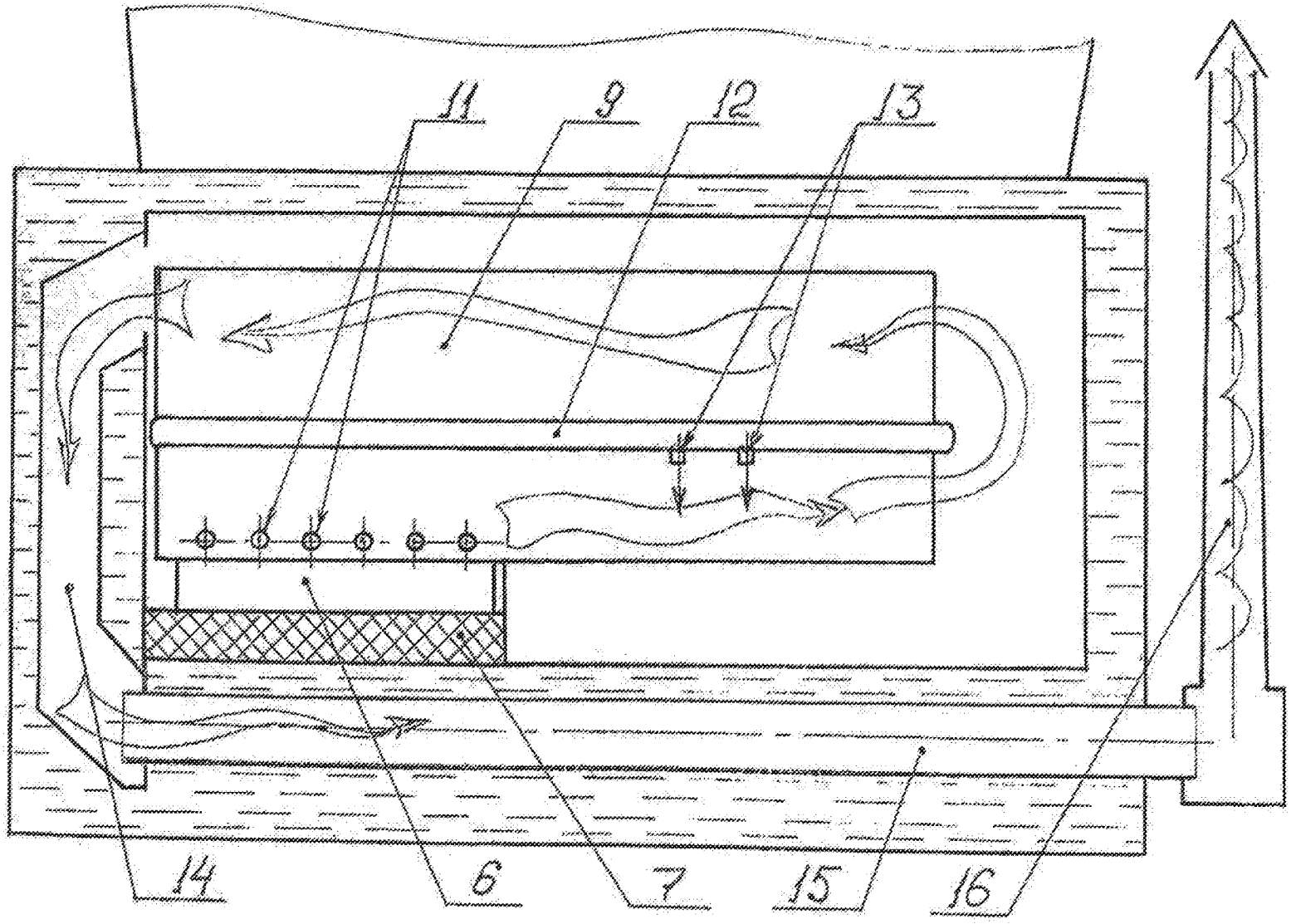
FIG. 2 shows a longitudinal section of the device in the embodiment with flame tubes and nozzle openings for supplying additional secondary air.

The pyrolysis boiler contains a hopper for solid fuel 1, a gasification chamber 2 with a heat-resistant thermal insulation coating 3 and a pyrolysis gas exit window with a grate 4, two compartments of the pyrolysis gas combustion chamber 5 with horizontal slots 6 and figured heat-resistant inserts 7, a cavity with water 8 surrounding the combustion chamber, air ducts 9 made in the form of flat ducts with nozzle openings for supplying primary air 10 and secondary air 11 installed in the form of a longitudinal horizontal partition in the compartments of the combustion chamber, flat box-shaped air ducts 12 with nozzle openings for supplying additional secondary air 13, gas flue 14, flame tubes 15, smoke pipe 16, ash collection box 17 installed below the grate.

The pyrolysis boiler works as follows: Solid fuel (for example, firewood or wood chips with a natural moisture content) is loaded into the hopper 1. Due to gravity, wood fuel goes down, successively passing through the drying zone (upper part of the hopper), dry distillation zone (lower part of the hopper) and entering the gasification chamber 2.

The air blown by the external fan (not shown) to the box-shaped air duct 9 is heated through the walls of the duct by the flame in the combustion chamber 5 and is forwarded at high speed to the upper part of the gasification chamber through the nozzle openings 10, where the process of incomplete combustion (smouldering) of wood fuel takes place. Wood fuel is gasified under the influence of the heat from smouldering, as well as from being heated by the hot walls of the combustion chamber compartments, and the pyrolysis gas formed during this process moves through a layer of hot coal to the exit window 4 located at the bottom of the gasification chamber, and then, turning 90 degrees left and right through the slots 6, enters the compartments of the combustion chamber. The heat-resistant thermal insulation of the internal walls of the gasification chamber protects the metal surfaces from burning out (thermal erosion) and, due to its heat capacity, smoothes random temperature fluctuations inside the gasification chamber.

The flow of hot secondary air exiting the box-shaped air duct 9 through the nozzle openings 11 at high speed (10-20 m/s) carries with it the flow of pyrolysis gas, mixes with it, and the resulting gas mixture ignites. Due to its high heat capacity and low thermal conductivity, the figured heat-resistant insert 7 maintains a stable high temperature in the ignition zone, and its shape contributes to the vortex motion of the gas mixture, which provides high-quality mixing of the fuel (pyrolysis gas) and the oxidant (air). To ensure optimal combustion conditions, secondary air is supplied in two zones: through the openings 11 at the entrance to the combustion chamber and through the openings 13 along the flame flow.

The stream of hot combustion products moves to the opposite end of the combustion chamber compartment, turns 180 degrees and comes back, moving above the horizontal partition 12; such movement scheme of the combustion products provides intensive heating of the gasification chamber along its entire height. Thereafter, the combustion products move through the gas flue 14 into flame tubes 15, and upon exiting, the gas flow is released into the atmosphere through the smoke pipe 16.

The optimal temperature of the side walls of the gasification chamber for gasifying moist wood fuel is achieved by adjusting the speed of the air flow moving through the box-shaped air duct 9, selecting the appropriate surface area of the box-shaped air duct or by replacing the solid box with a flat grid of individual tubes; thus, the design allows to achieve a stable and controlled gasification of wood fuel.

Heat transfer to the heat-transfer fluid (water) circulating in the cavity 8 is carried out in two zones: on the surface of the external walls of the combustion chamber 5 compartments and through the flame tubes 15; in the first zone, convective heat transfer from combustion gases to the wall of the combustion chamber is complemented by powerful heat radiation from a high-temperature (more than 1000° C.) flame. Thus, the claimed design maintains the main advantage of the traditional scheme (effective heat transfer from the heated walls to the "water jacket"), while being free from the main disadvantage of the traditional scheme, since in the claimed design, the heat transfer fluid does not contact the gasification chamber at any point and therefore does not cool it.

The invention claimed is:

1. A pyrolysis boiler comprising:

a single vertical housing comprising within a rectangular hopper for solid fuel and a gasification chamber below the rectangular hopper, which has an internal heat-resistant thermal insulation coating, and an outlet window with a grate whereby pyrolysis gases can exit;

a pyrolysis gas combustion chamber in the form of two symmetrical, parallel, horizontal compartments;

primary and secondary air supply ducts supplying primary and secondary air and a pressure fan installed outside the housing;

a double-walled water cavity surrounding the pyrolysis gas combustion chamber, in such a way, that an outer wall of the combustion chamber is also an inner wall of the water cavity, wherein the gasification chamber is placed with no gap between the two compartments of the pyrolysis gas combustion chamber, and horizontal slots are located into side surfaces of the compartments of the combustion chamber facing the gasification chamber, which ensure that flow of the pyrolysis gas passes from the outlet window of the gasification chamber to the combustion chamber with the flow turning 90 degrees left and right.

2. The pyrolysis boiler of claim 1, wherein the primary and secondary air supply ducts are made in the form of flat ducts and installed on the side surfaces of the combustion chamber compartments facing the gasification chamber, while these ducts cover only a part of the side surface area of the combustion chamber compartments.

3. The pyrolysis boiler of claim 2, wherein nozzles for supplying secondary air are placed in the secondary air supply ducts, in such a way, that the flow of secondary air coming from them moves at a speed of about 10-20 m/s parallel to, in the same direction as and in close proximity to the flow of the pyrolysis gas entering through the horizontal slots into the combustion chamber compartments.

4. The pyrolysis boiler of claim 1, wherein the primary and secondary air supply ducts are made in the form of a flat grid of circular or rectangular pipes and installed on the side surfaces of the combustion chamber compartments facing the gasification chamber, and wherein the pipes cover only a part of the side surface area of the combustion chamber compartments.

5. The pyrolysis boiler of claim 4, wherein nozzles for supplying secondary air are placed in the flat grid, in such a way, that the flow of secondary air coming from them moves at a speed of about 10-20 m/s parallel to, in the same direction as, and in close proximity to the flow of the pyrolysis gas entering through the horizontal slots into the combustion chamber compartments.

6. The pyrolysis boiler of claim 1, wherein nozzles for supplying secondary air are placed in the secondary air supply ducts in such a way that the flow of secondary air coming from them moves at a speed of about 10-20 m/s parallel to, in the same direction as and in close proximity to the flow of the pyrolysis gas entering through the horizontal slots into the combustion chamber compartments.

7. The pyrolysis boiler of claim 1, wherein the horizontal slots of the pyrolysis gas inlet are 2-3 times shorter than the length of the combustion chamber compartment and are located at the front end of the combustion chamber compartments.

8. The pyrolysis boiler of claim 1, wherein a figured insert made of heat-resistant insulating material is installed in each compartment of the combustion chamber opposite the horizontal slots of the pyrolysis gas inlet, covering at least two surfaces of the combustion chamber, being, the bottom and side wall opposite the horizontal slots.

9. The pyrolysis boiler of claim 1, wherein each compartment of the combustion chamber is equipped with a longitudinal horizontal partition, the length of which is less than the length of the compartment, wherein the partition without a gap is in contact with the front end of the combustion chamber compartment.

10. The pyrolysis boiler of claim 9, wherein the longitudinal horizontal partition has a form of a flat box, with the air flow moving inside it and the outer surface of the box containing nozzle openings for supplying secondary air into the combustion chamber.

11. The pyrolysis boiler of claim 1, wherein the water cavity contains a fire-tube heat exchanger, the inlet of which is connected to an outlet of the combustion chamber compartments by means of a gas flue, and the exit of which is connected to a smoke flue opening to the atmosphere by means of the gas flue.

* * * * *